US012042023B2

(12) United States Patent
Lim

(10) Patent No.: US 12,042,023 B2
(45) Date of Patent: Jul. 23, 2024

(54) ORNAMENT HOOKED OVER PROJECTING PART FOR FASTENING

(71) Applicant: Dong Wook Lim, Seoul (KR)

(72) Inventor: Dong Wook Lim, Seoul (KR)

( * ) Notice: Subject to any disclaimer, the term of this patent is extended or adjusted under 35 U.S.C. 154(b) by 70 days.

(21) Appl. No.: 17/612,376

(22) PCT Filed: Sep. 10, 2019

(86) PCT No.: PCT/KR2019/011771
§ 371 (c)(1),
(2) Date: Nov. 18, 2021

(87) PCT Pub. No.: WO2021/049682
PCT Pub. Date: Mar. 18, 2021

(65) Prior Publication Data

US 2022/0218073 A1 Jul. 14, 2022

(51) Int. Cl.
*A44B 1/04* (2006.01)
*A44B 1/18* (2006.01)

(52) U.S. Cl.
CPC . *A44B 1/04* (2013.01); *A44B 1/18* (2013.01)

(58) Field of Classification Search
CPC .... A44B 1/04; A44B 1/18; A44B 1/14; Y10T 24/32; Y10T 24/1934; Y10T 24/367; A43C 11/02
See application file for complete search history.

(56) References Cited

U.S. PATENT DOCUMENTS 168,332 A * 10/1875 Hill ..... A44B 1/18 24/563
2,577,723 A * 12/1951 Groh ..... A44B 1/14 24/113 MP
3,353,231 A * 11/1967 Levine ..... A44B 1/14 24/113 MP
3,777,336 A * 12/1973 Anderson ..... A44B 1/14 451/448

(Continued)

FOREIGN PATENT DOCUMENTS

JP 05-009306 U 9/1993
KR 10-1307291 B1 10/2013

(Continued)

OTHER PUBLICATIONS

International Search Report from corresponding PCT Application No. PCT/KR2019/011771, dated Jun. 9, 2021.

*Primary Examiner* — Robert Sandy
*Assistant Examiner* — Rowland Do
(74) *Attorney, Agent, or Firm* — Harness, Dickey & Pierce, P.L.C.

(57) ABSTRACT

An ornament hooked over a button to be fastened includes a plate-shaped body, a ring-shaped hooking assistive device, combined with the body and made by bending a long plate to be a ring open on one side, and a first ornamental part covering the body above the hooking assistive device, wherein the body is formed with an inlet in the direction from the center into which the ornament is hooked over a button to make the button pass through the inlet of the body (Continued)

and place at the center of the body; a wall is formed as an upward projection from a part of the outer circumferential surface of the body to be combined with the first ornamental part on top of the wall.

3 Claims, 5 Drawing Sheets

(56) References Cited

U.S. PATENT DOCUMENTS

| | | | | | |
|---|---|---|---|---|---|
| 5,060,356 | A * | 10/1991 | Szedzinski | A44B 1/14 | 24/113 MP |
| 5,161,285 | A * | 11/1992 | Jerjian | A44B 1/14 | 24/113 MP |
| 5,337,584 | A * | 8/1994 | Angeli | A44C 15/001 | 63/1.17 |
| 5,394,719 | A * | 3/1995 | Fang | A44B 1/14 | 63/20 |
| 5,621,951 | A * | 4/1997 | Gould | A44B 1/14 | 24/113 MP |
| 6,035,494 | A * | 3/2000 | Duke | A44B 1/14 | 24/113 MP |
| 6,857,167 | B2 * | 2/2005 | Bishop | A45F 5/02 | 24/113 MP |
| 7,350,274 | B2 * | 4/2008 | Rogers | A44B 1/14 | 24/113 MP |
| 8,726,469 | B1 * | 5/2014 | Delaneau | A44B 1/04 | 24/113 MP |
| D751,461 | S * | 3/2016 | Pershinsky | D11/222 | |
| 9,307,806 | B1 * | 4/2016 | Dorman | A47G 25/92 | |
| 9,433,257 | B2 * | 9/2016 | Taetzsch | A44B 1/04 | |
| D784,194 | S * | 4/2017 | Nielsen | D11/222 | |
| D793,903 | S * | 8/2017 | Bolen | D11/222 | |
| 10,070,697 | B1 * | 9/2018 | Melgoza | A44C 3/001 | |
| 10,194,717 | B2 * | 2/2019 | Ort | A44B 1/04 | |
| D889,315 | S * | 7/2020 | Herriot | D11/222 | |
| 2004/0226145 | A1 | 11/2004 | Ouellette | | |
| 2012/0117763 | A1 * | 5/2012 | Patel | A44B 1/04 | 24/102 SL |
| 2016/0360810 | A1 * | 12/2016 | Lim | A41F 1/002 | |

FOREIGN PATENT DOCUMENTS

| | | | |
|---|---|---|---|
| KR | 20-0471068 | Y1 | 2/2014 |
| KR | 10-2019-0136871 | A | 12/2019 |

* cited by examiner

ORNAMENT HOOKED OVER PROJECTING PART FOR FASTENING

CROSS-REFERENCE TO RELATED APPLICATIONS

This application is a National Phase entry of PCT Application No. PCT/KR2019/011771, filed 10 Sep. 2019. The entire disclosure of the application identified in this paragraph is incorporated herein by reference.

TECHNICAL FIELD

The present invention relates to an ornament hooked over a projecting part for fastening.

BACKGROUND ART

The present disclosure relates to an ornament to be used in clothing by hooking it over a projecting part to fasten it. Exemplary ornaments used in clothing include brooches, tie clips, etc., some buttons wrought in special shapes, jewels, glass, crystals or other jewels used in clothing, and some buttons have been made with such jewels.

By the way, unless such an ornament is attached to men's clothing when they are manufactured, later attachment thereof is difficult in many cases; attaching it to the clothing in the manufacturing stage increases manufacturing costs; the clothing not wearable any more is thrown away along with the ornament; and recycling is not easy and application of expensive ornaments are thus usually not ideal because they cannot be used for other purpose although they are detached and saved in many cases.

Moreover, there are not various ornaments that can be attached to clothing, and an exemplary ornament for the purpose includes the only one attached to buttons proposed in Utility Model Registration No. 20-0471068 of Korea "Ornament Used for Clothing" proposed by the applicant of this disclosure.

Therefore, there is a need for an ornament made to be used for any type of clothing by attaching it to various ready-made types of clothing anytime to allow it to be attached and used when required.

Furthermore, while the ornament proposed by the applicant of this disclosure can be used by hooking it over buttons to be fastened, such an ornament can sometimes be turned when hooked over the buttons because it is hooked and fastened.

While expensive ornaments are fastened to clothing in many cases, it is not ideal to attach expensive ornaments to other hats, bags or shoes than clothing, also men's clothing, and there is a great need for the ornament in accordance with the present disclosure applicable to the aforementioned items.

SUMMARY

Technical Problem

Therefore, the present disclosure provides an ornament addressing the aforementioned problems, to be used by hooking it over a button to be fastened and not to allow its movement over the button, and allowing its replacement.

Technical Solution

In view of the above description, the present disclosure provides an ornament which is hooked over a button to be fastened, and includes a plate-shaped body 11; a ring-shaped hooking assistive device 12, combined with the body and made by bending a long plate to be a ring open on one side; and a first ornamental part covering the body 11 above the hooking assistive device 12, wherein the body 11 is formed with an inlet 14 in the direction from the center into which the ornament is hooked over a button to make the button pass through the inlet of the body and place at the center of the body 11, and a wall 15 is formed as an upward projection from a part of the outer circumferential surface of the body 11 to be combined with the first ornamental part 13 on top of the wall 15; since the hooking assistive device 12 is attached to the wall 15 of the body 11 and the opening of the hooking assistive device 12 is in the same direction as the direction of the inlet 14, the hooking assistive device 12 touches the button and is widened when the button is pushed through; and the thread used for sewing the button passes through the inlet 14 to allow the hooking assistive device 12 to fasten the button by means of elasticity after the button is pushed through.

It is allowed to combine a second ornamental part with the top of the first ornamental part 13 to implement various types of decoration whatever users want.

At least one end of the hooking assistive device 12 is formed with inlet rings 19 rolled outward to make the part touching the button curved when the button is pushed through and taken out for implementing easy hooking and releasing.

The distance between both sides of the lower half of the hooking assistive device 12 can be smaller as it goes down.

The inner side of the wall 15 has a wall coupling stud 17 projecting in the direction perpendicular to the wall, and the wall coupling stud 17 is inserted into an opening 18 formed at the back of the hooking assistive device 12 for coupling, and the inside of the wall coupling stud 17 which is hollow can be closed and secured with a cap.

The wall of the body can be formed just around the circumferential surface in the upper half when the body is divided into two halves of upper and lower areas.

The wall of the body can be formed around the entire circumferential surface except the inlet.

Advantageous Effects

The present disclosure provides an ornament with the aforementioned configuration, hooked over a button to implement various styles by hooking it over threads used for sewing the button and not allowing the button to turn when hooked over the button.

DETAILED DESCRIPTION

Figure 1:
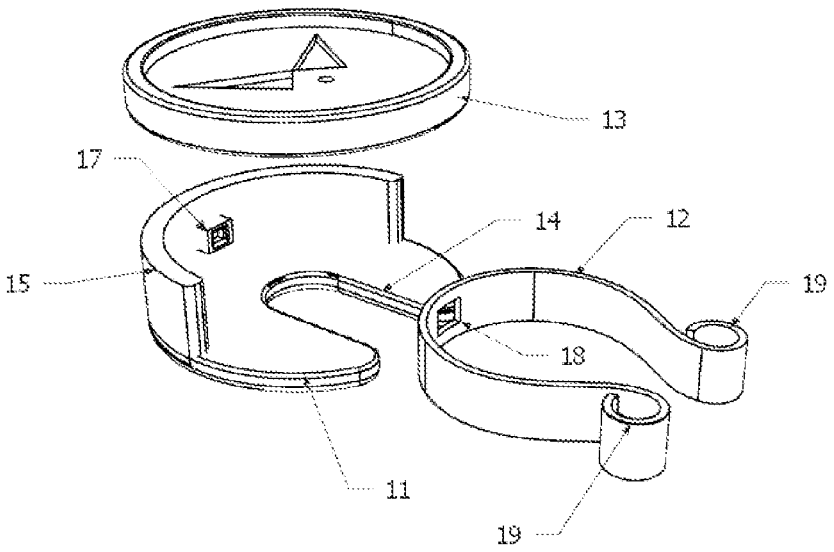
FIGS. 1, 2, 3, 4, 5, 6, 7, 8 and 9 show an embodiment in accordance with the present disclosure.

The present disclosure will be described in detail hereinbelow with reference to the accompanying drawings. The ornament in accordance with the present disclosure is configured to have a body 11, a hooking assistive device 12 and a first ornamental part 13, wherein the body 11 in a round plate shape is formed with an inlet 14 in one direction into which a button is pushed through, and a wall 15 in the direction opposite to the location where the inlet 14 is formed. The wall 15 projects from a part of circumferential surface of the wall 15 and is formed in the direction perpendicular to the body 11 along the circumferential surface of body 11. The end of projected wall 15 is combined with the first ornamental part 13. In many cases, the first ornamental part 13 functions as a cover, and a second ornamental part 16 can be combined with the top of the first ornamental part 13.

The body 11 can be in a round, rectangular or other polygonal shape, and it is easier to hook a plate-shape body over buttons. The distance between both sides of the inlet 14 can be larger gradually as it is farther from the center, and the distance between both sides of the inlet 14 is not important and can be uniform as long as the button can be hooked.

A wall coupling stud 17 of which the inside is hollow projects from the inner side of the wall 15 of the body 11, and is inserted into an opening for coupling 18 formed at the back of the hooking assistive device 12 to be coupled, and the groove in the wall coupling stud 17 is closed and secured with a separate cap.

The hooking assistive device 12 is in a ring shape of which the one side is open, and both ends thereof are rolled outward to form the inlet rings 19. The inlet rings 19 can be formed at any one end of the device 12, and different shapes thereof are also applicable. While the side of a button touches the inlet rings 19 when the button is pushed through, a great force is not required to push the button through by forming the inlet rings 19 to make the touching part round, and holding and pulling out the body 11 is enough to take the ornament out easily while the side of button touches the inlet rings 19.

Since the button is enclosed in the hooking assistive device 12 by means of the elasticity of the hooking assistive device 12, the button is not easily taken out where the button is not intentionally taken out after it goes into the hooking assistive device 12. The hooking assistive device 12 is in the shape similar to the uppercase Omega in Greek alphabets, Ω, and it is not necessary that both sides are symmetrical. The radius of the lower half in the hooking assistive device 12 can be smaller as it goes down. While the distance between both sides of the hooking assistive device 12 can be the smallest where the inlet rings 19 are formed, the hooking assistive device 12 is widened towards both sides because of the elasticity of the hooking assistive device 12 although slightly big buttons are pushed through, and a button bigger than the distance between the inlet rings 19 of the hooking assistive device 12 closely touches the hooking assistive device 12 in any one location in the hooking assistive device 12 because the radius is smaller as it goes down to hold the button not to move.

Furthermore, since the distance between the inlet rings 19 is smaller than the diameter of the button, the button is not easily taken out, and the hooking assistive device 12 is in a ring shape to return to its original shape after the button is pushed inside by means of elasticity. A first ornamental part 13 is formed on top of the wall 15 and has a diameter similar to the diameter of the body 11 to cover and hide the body 11 and the button located above the body. The first ornamental part 13 itself can be used for decoration, or it is possible to insert or attach a second ornamental part 16 into or to the first ornamental part 13 for decoration. For the second ornamental part 16, various materials, shapes or colors can be used to allow users to select any one they like.

The wall 15 of the body should be formed just on the circumferential surface of the upper half when the body is divided into two halves of upper and lower areas. The lower half without any wall allows buttons bigger than the body to be hooked over. Where the ornament is made only for small buttons, however, the wall 15 can be formed on the entire circumferential surface except the inlet.

Figure 2:
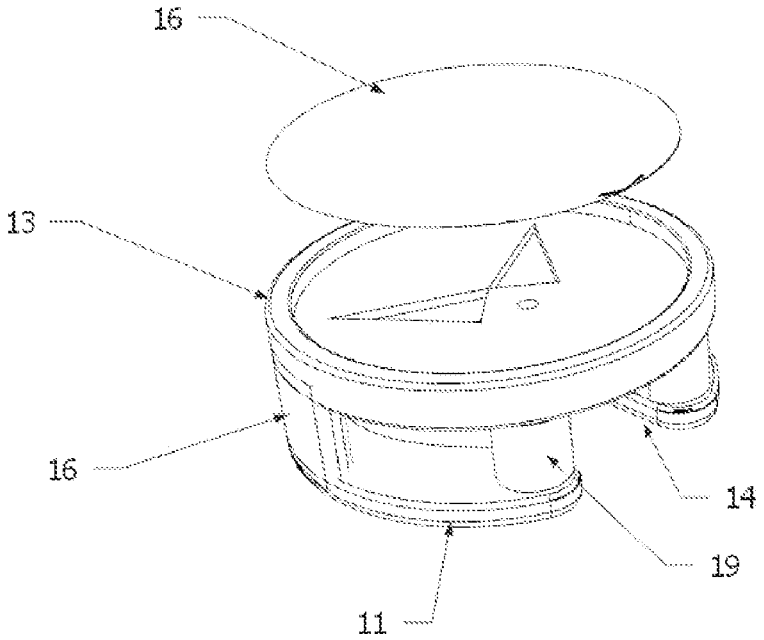
Figure 3:
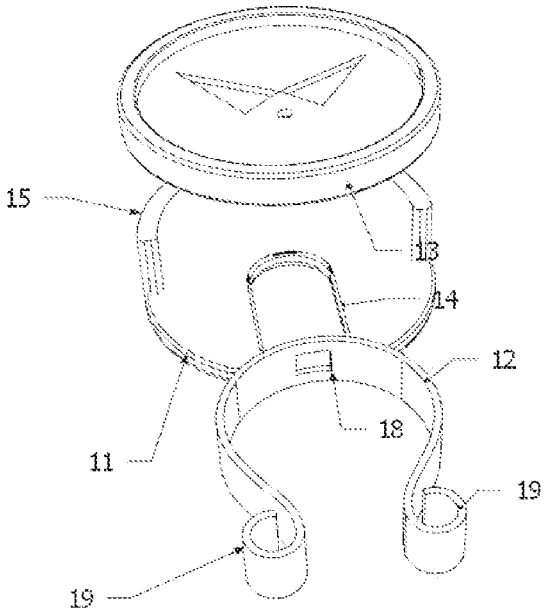
Figure 4:
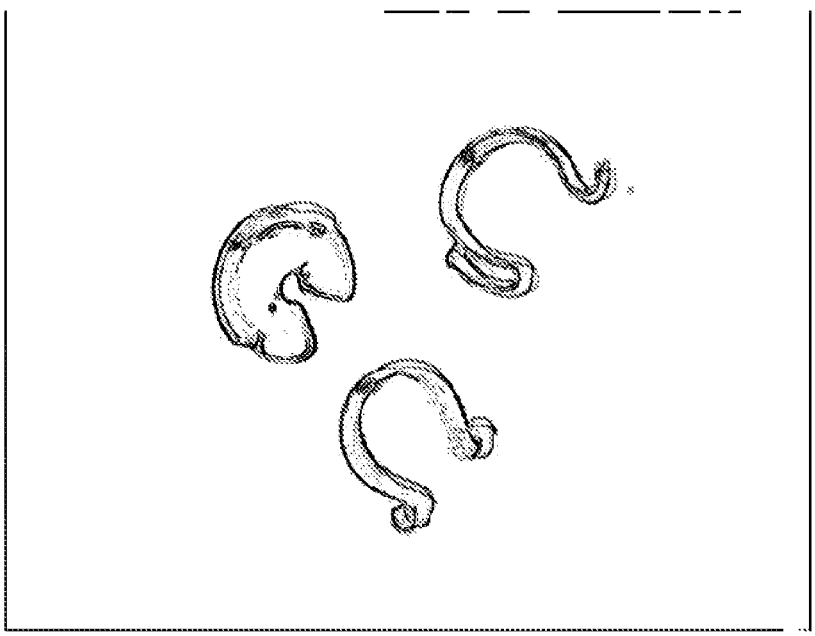
Figure 5:
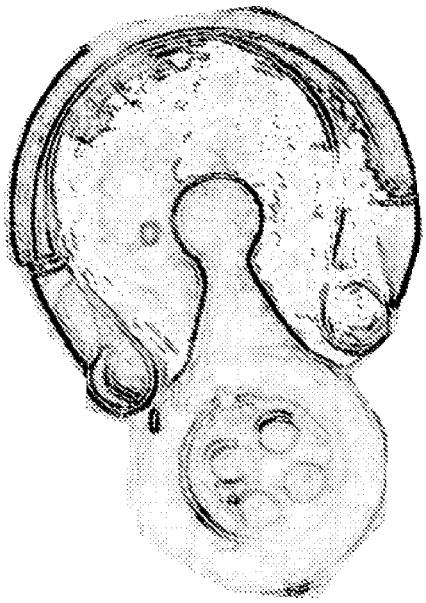
Figure 6:
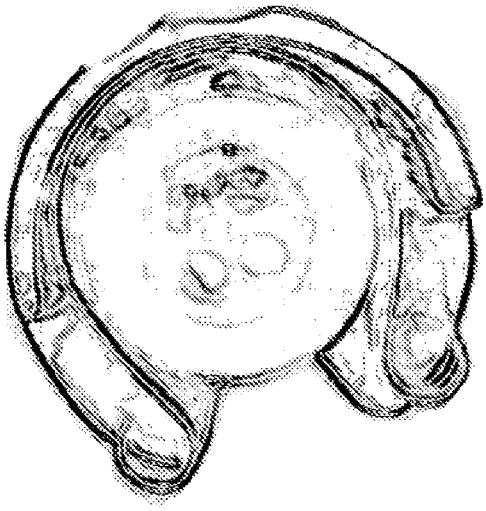
Figure 7:
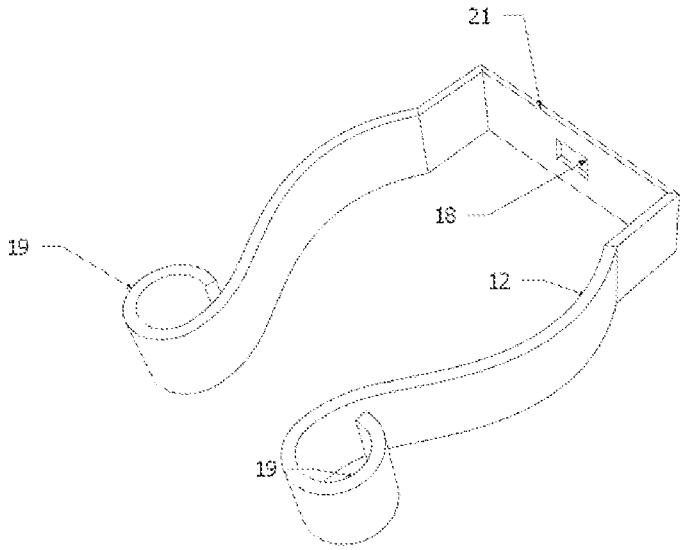
Figure 8:
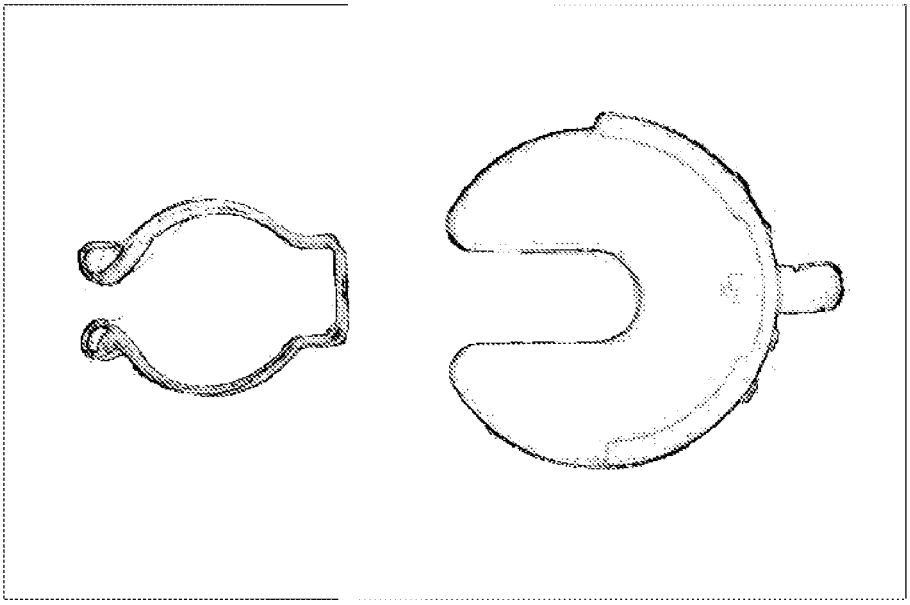
Figure 9:
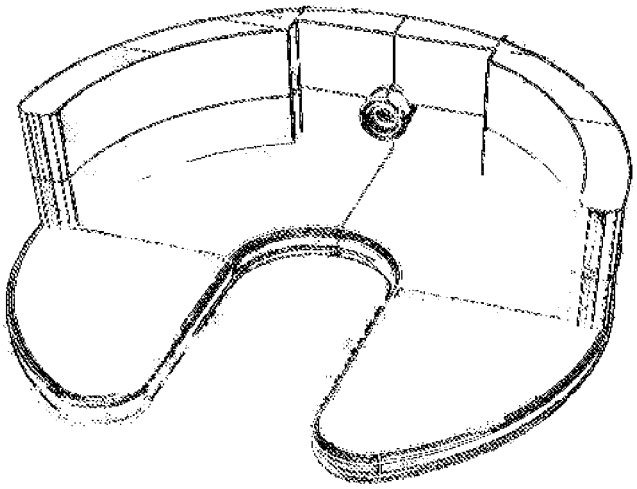

FIGS. 1, 2 and 3 show the configuration of the ornament in accordance with the present disclosure, and FIG. 4 shows components actually made. The hooking assistive device 12 is in a ring shape of which the one side is open, and the inlet rings 19 can be formed at least at one end, not requiring a symmetrical shape. FIGS. 5 and 6 show operation of the ornament actually made.

For easy illustration, this disclosure describes the ornament only for buttons. In addition to the buttons, however, the ornament can be applied to any projecting parts in clothing or small items. For example, it can be applied to any projecting parts of ornaments including jewels attached for decoration, locks or corners in a bag in addition to buttons.

While the present disclosure has been shown and described, the present disclosure is not limited to the aforementioned description and accompanying drawings. It will be understood by those skilled in the art that various substitutions, changes and modifications can be made without departing from the scope of the present disclosure as defined in the following claims.

| Description of Numerals | |
|---|---|
| 11: body | 12: hooking assistive device |
| 13: first ornamental part | 14: inlet |
| 15: wall | 16: second ornamental part |
| 17: wall coupling stud | 18: opening for coupling |
| 19: inlet ring | |

What is claimed is:

1. An ornament hooked over a button to be fastened, comprising:

a plate-shaped body;

a ring-shaped hooking assistive device, combined with the body and made by bending a long plate to be a ring, open on one side; and a first ornamental part covering the body above the hooking assistive device, wherein the body is formed with an inlet in the direction from the center into which the ornament is hooked over a button to make the button pass through the inlet of the body and place at the center of the body;

a wall is formed as an upward projection from a part of the outer circumferential surface of the body to be combined with the first ornamental part on top of the wall; and since the hooking assistive device is attached to the wall of the body and the opening of the hooking assistive device is in the same direction as the direction of the inlet, the hooking assistive device touches the button and is widened when the button is pushed through, and the thread used for sewing the button passes through the inlet to allow the hooking assistive device to fasten the button by means of elasticity after the button is pushed through, wherein a second ornamental part is combined with the top of the first ornamental part to implement various types of decoration whatever users want, wherein at least one end of the hooking assistive device is formed with an inlet ring rolled outward to make the part touching the button curved when the button is pushed through and taken out for implementing easy hooking and releasing, wherein the distance between both sides of the lower half of the hooking assistive device is smaller as it goes down, and wherein the inner side of the wall has a wall coupling stud projecting in the direction perpendicular to the wall, and the wall coupling stud is inserted into an opening formed at the back of the hooking assistive device for coupling, and the inside of the wall coupling stud which is hollow.

2. The ornament of claim 1, wherein the wall of the body is formed just around the circumferential surface in the upper half when the body is divided into two halves of upper and lower areas.

3. The ornament of claim 1, wherein the wall of the body is formed around the entire circumferential surface except the inlet.

* * * * *